US005937547A

United States Patent [19]

Abbey

[11] Patent Number: 5,937,547

[45] **Date of Patent: *Aug. 17, 1999**

[54] STUD FOR SPORT SHOES

[75] Inventor: Edward F. Abbey, Frankfort, Mich.

[73] Assignee: Greenspike, Inc., Frankfort, Mich.

[ * ] Notice: This patent is subject to a terminal disclaimer.

[21] Appl. No.: 08/763,549

[22] Filed: Dec. 10, 1996

Related U.S. Application Data

[62] Division of application No. 08/642,593, May 3, 1996, Pat. No. 5,623,774.

[51] Int. Cl.[6] ..... A43B 5/00; A43B 15/00

[52] U.S. Cl. ..... 36/134; 36/127; 36/67 A; 36/67 D; 36/59 C; 36/65

[58] Field of Search ..... 36/134, 127, 67 R, 36/67 D, 67 A, 65, 66

[56] References Cited

U.S. PATENT DOCUMENTS

| | | | |
|---|---|---|---|
| 2,682,714 | 7/1954 | Phillips | 36/67 D |
| 5,243,775 | 9/1993 | Swain | 36/67 D |
| 5,259,129 | 11/1993 | Deacon et al. | 36/127 |

*Primary Examiner*—M. D. Patterson
*Attorney, Agent, or Firm*—Donald R. Fraser

[57] ABSTRACT

A stud for sport shoes wherein the shoes are provided with internally threaded sockets for receiving the stud, the stud comprises: a main body portion having an upper and a lower surface; a shank extending outwardly from the upper surface of the body portion and having an outer dimension enabling the same to be threadably received within the threaded sockets of the sport shoe; and a plurality of concentric spaced apart ridges extending outwardly from the lower surface of the body portion to provide traction between the shoe and a supporting surface.

4 Claims, 1 Drawing Sheet

STUD FOR SPORT SHOES

This application is a division of Ser. No. 08/642,593 filed May 3, 1996 now U.S. Pat. No. 5,623,774.

BACKGROUND OF THE INVENTION

1. Field of the Invention

The present invention relates to sport shoes and more particularly to studs used for footwear of the type used for playing golf.

Typically, footwear used by golfers includes a plurality of threaded sockets embedded in the sole of the golfing shoe. Stud members having threaded shanks are threadably engaged in the sockets. A broad flange is adapted to generally surround each of the sockets and engages the sole of the shoe and a stud or spike extends outwardly from each of the flanges. In the event of wear, the stud and the associated flange and threaded shank can be removed from the shoe and a replacement can be threadably reinserted into the socket.

It has been found that the above described studs are deleterious to the golf courses and particularly the greens. In their regard it has been determined that golf shoes with the conventional metal spikes cause more turf damage under all conditions than any other shoes tested. It has further been found that the belief that the conventional spikes were beneficial in verifying the greens was incorrect. According to studies conducted by the United States Golf Association (USGA), the compaction of the soil is caused in large part by the weight—bearing shoulder or flange of the metal spike as well as the associated bearing surfaces. Spike marks are a serious problem in the maintenance of bent grass greens. While all shoes can spread disease and undesirable plants, spikes actually amplify the problems associated with Poa annua invasion by weakening the turf and thereby militating against the ability of the bent grasses, for example, to compete with undesirable foreign grasses.

2. Description of the Prior Art

In 1993 new types of studs were introduced as a viable alternative to the metal spikes. The new alternative spikes were non-penetrating urethane replacement studs having a circular plastic base with ridges fashioned in a fan-like design extending outwardly therefrom to provide traction.

The advantages of the non-penetrating studs include reduced damage to the turf, carpet, asphalt, and golf cars to name a few. It also has been found that these newly introduced studs were actually easier on the human body, and were more comfortable and placed less strain on the feet, ankles, knees, hips, and back.

While the non-penetrating studs resulted in a number of advantages to the golf player and the attendant golf course, the disadvantages included a slight reduction in traction and durability. It was also found that certain of the studs inherently loosened during use.

SUMMARY OF THE INVENTION

It is an object of the present invention to produce a stud for sport shoes which provides the user with sufficient traction to properly and safely participate in the game of golf while not penetrating the greens and fairways to cause damage thereto.

It is another object of the invention to produce a substantially non-penetrating stud for sport shoes which can readily replace the conventional metal spikes of golf shoes, for example.

Another object of the invention is to produce a non-penetrating stud for golf shoes which will provide the desired traction at any angle.

Still another object of the invention is to produce a stud for golf shoes which is capable of distributing the force of thrust and/or shear over a wide area on the circumference thereof.

Still a further object of the invention is to produce a stud for golf shoes which will resist thrust or shear equally at any point on the circumference thereof.

A further object of the invention is to produce a stud for golf shoes which is monolithic in structure and can be readily manufactured of known and available materials with known and available molding equipment.

The above as well as other objects and advantages of the invention can be achieved by a stud comprising a main body portion having an upper and a lower surface; a shank portion extending outwardly from the upper surface of the body portion and having an outer dimension enabling the same to be threadably received within suitable threaded sockets formed on the sole of a sports shoe, and a plurality of concentric spaced apart ridges extending outwardly from the lower surface of the body portion to provide traction between the sports shoe and a supporting surface.

Further objects and advantages of this invention will be apparent from the following description and appended claims, reference being made to the accompanying drawings forming a part of the specification, wherein like reference characters designate corresponding parts in the several views.

DETAILED DESCRIPTION OF THE PREFERRED EMBODIMENT

Figure 1:
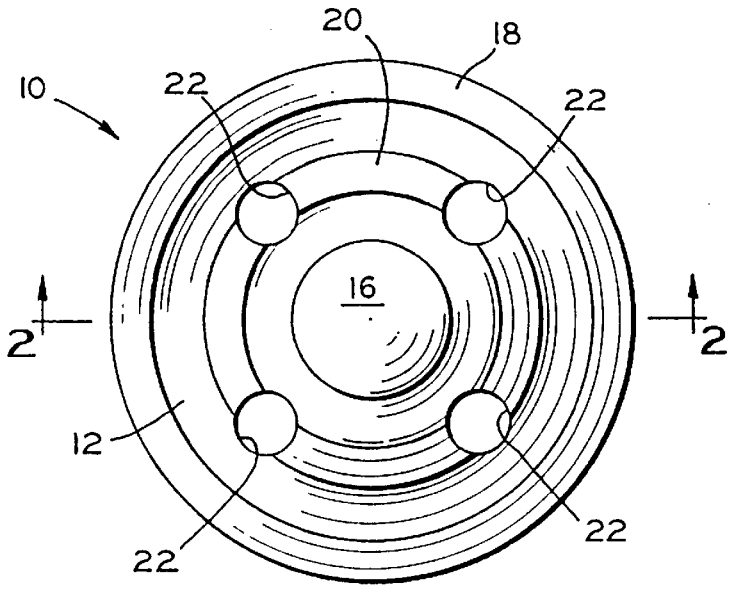
FIG. 1 is a plan view of a stud incorporating the features of the present invention.

Referring to the drawing, there is illustrated a stud, generally indicated by reference numeral 10, incorporating the features of the invention. The stud 10 is typically formed in any suitable material, such as a plastic material for example. It has been found that a Nylon plastic material containing a small addition of clay and calcium carbonate manufactured by E.I. DuPont and sold under the commercial designation of DuPont 6R2 Zytel #77633L has exhibited excellent results. The product exhibits many exemplary characteristics such as high wear and abrasion resistance, high strength to weight ratio, corrosion resistance to alkalies and organic chemical, excellent electrical insulation property, and low moisture absorption.

The stud 10 may be formed by a plastic injection molding process practiced by any of the well known commercially available injection molding machines.

The stud 10 is provided with a main body portion 12. A tapered shank 14 is formed to extend perpendicularly outwardly from one surface of the body portion 12. The distal end of the shank 14 may be chambered to facilitate the introduction of the shank into an associated internally threaded socket of a fitting attached to the sport shoe to which the stud is to be attached as will be explained in greater detail in reference to FIG. 3. Also, it should be noted that in the preferred embodiment of the invention, the taper of the shank 14 is such that the terminal end of the shank 14 is slightly narrower than the proximal end thereof.

The opposite surface of the main body portion of the stud 10 is the gripping surface and is provided with a surface configuration to produce traction between stud and a supporting surface such as the fairway or green surfaces of a golf course. Such configuration is designed to be substantially non-penetrating insofar as the golf course surface is concerned. And further, the configuration functions to provide traction throughout a complete three hundred and sixty degrees.

More specifically, the gripping surface is comprised of a central upstanding cylinder 16, a circumferentially disposed rib 18, and an intermediate rib 20.

A series of four equidistantly spaced apertures 22 are provided which extend through the rib 20 and the main body portion 12. The apertures 22 cause four spaced apart interruptions in the rib 20.

Figure 2:
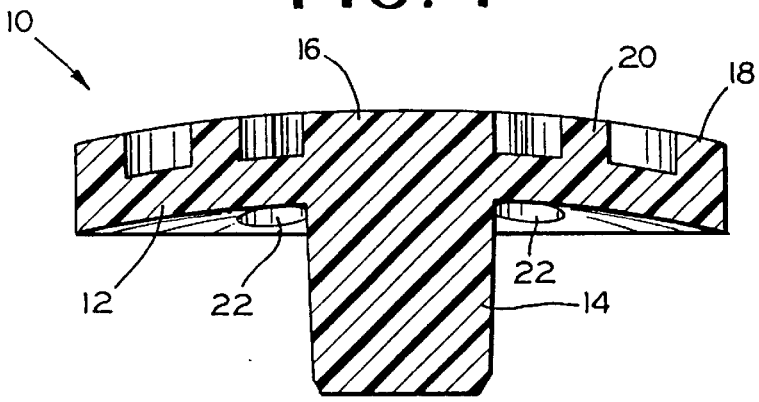
FIG. 2 is a sectional view of the stud illustrated in FIG. 1 taken along line 2—2 thereof.

It will be observed from viewing the sectional view of FIG. 2 that the centrally disposed cylinder 16, and the ribs 18 and 20 are all provided relatively flat exposed outer surfaces which are defined by spaced apart generally parallel side walls which extend outwardly from the outer surface of the main body portion 12. It will be noted that inner and outer surfaces of the main body portion, as well as the exposed outer surfaces of the cylinder 16, and the ribs 18 and 20 are all formed on the same radius resulting in a slightly shallow dish-shaped profile.

The stud 10 illustrated in FIGS. 1 and 2 may be attached to sport shoes. A series of four equidistantly spaced apertures 22 are provided which extend through the rib 20 and the main body portion 12. The apertures 22 cause four spaced apart interruptions in the rib 20.

Figure 3:
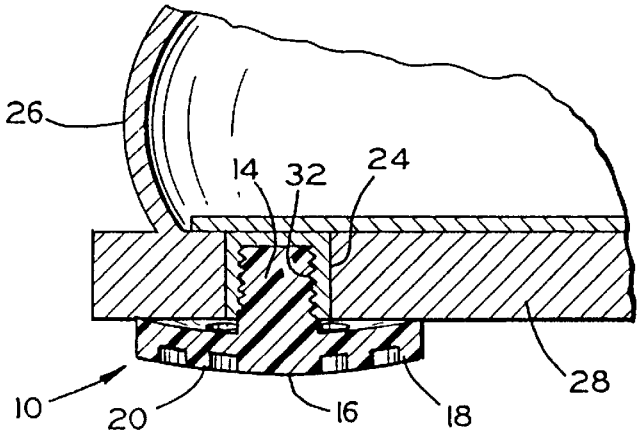
FIG. 3 is an enlarged fragmentary view of the stud illustrated in FIGS. 1 and 2 mounted in an internally threaded receptacle of an associated sport shoe.

The stud 10 illustrated in FIGS. 1 and 2 may be attached to particular golf shoes as illustrated in FIG. 3. Each of the studs 10 is attached to an internally threaded receptacle 24 that is typically permanently imbedded with the sole and heel of an associated shoe. The shoe includes a shoe upper 26, a sole 28 and a heel, not shown. It can be seen that the receptacles 24 are imbedded in spaced relation within the sole 28 and the heel, in the pattern set by the shoe manufacturer. The receptacle 24 is typically formed of metal and includes an internally threaded cavity 32. The internally threaded cavity is adapted to receive the shank 14. As the shank 14 is inserted into the threaded cavity 31, the stud 10 is typically rotated relative to the receptacle 24, and the threaded configuration of the cavity 32 forms a snug threaded connection with the tapered shank 14.

It will be noted that when the stud 10 is fully and completely attached to the receptacle 24 at least the outer peripheral portion of the facing surface of the body portion 12 is in contact with the facing surface of the shoe sole 28. The slight dish shape of the facing surface of the body portion 12 enables the body portion 12 to be in compression thus functioning to militate against any retrograde movement and resultant loosening of the stud 12.

In a preferred embodiment of the invention, it was found that satisfactory results were achieved by forming a stud, as illustrated in the drawings, with the following discussions:

Diameter of main body portion 12—⅞"

Width of concentric ridges 18 and 20—1/16"

Diameter of cylinder 16—¼"

Spacing between adjacent ridges 18, 20 and central cylinder 16—3/32"

Depth of above spacings—1/16"

Taper of the shank 14

Proximal end—0.232"

Distal end—0.228"

Diameter of apertures 22—1/16"

It will further be understood, the apertures 22 formed in the main body portion 12 are provided to receive the spaced prongs of conventional keys or wrenches used to install and/or remove the typical metal spikes from golf shoes, for example.

The stud 10 provides a traction device which will typically tend to contact the supporting surface such as a golf course fairway or green along a substantial portion of the trailing edges of adjacent arcs of the concentric ridges 18,20 and the centrally disposed cylinder 16 and what can be referred to as the complementary trailing edges of adjacent arcs of the concentric ridges 18,20 and the centrally disposed cylinder 16 at points which are substantially one hundred and eighty degrees displaced from the aforementioned trailing edges. Simultaneously, the edges of the ridge 18 which define the apertures 22 also function to provide additional traction during contact with the supporting surface.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A stud for attachment to the sole of a sport shoe wherein the sole has at least one internally threaded socket for receiving the stud, the stud comprising:

a main body portion formed of a plastic material, said body portion having an upper surface in facing relation to the sole of the sport shoe and a traction producing lower surface in spaced and generally parallel relation to the upper surface and in facing relation to a supporting surface; and attachment means consisting of a substantially cylindrical shank formed of a plastic material, said shank being integral with and extending outwardly from the upper surface of said body portion, said shank having a smooth outer surface adapted to be threadably received by the threaded socket of the sole of the sport shoe.

2. A stud as claimed in claim 1 wherein said shank includes a proximal end adjacent the upper surface of said body portion and a terminal end.

3. A stud as claimed in claim 2 wherein said shank tapers inwardly from the proximal end to the terminal end thereof such that the terminal end of said shank is narrower than the proximal end to facilitate the self threading thereof as the stud is threaded into the internally threaded socket of the sport shoe to which the stud is to be attached.

4. A stud as claimed in claim 1 wherein the upper surface of said body portion is generally concave in respect of the sole of the sport shoe to which it is to be attached.

* * * * *